United States Patent [19]

Salmon

[11] Patent Number: 4,986,391

[45] Date of Patent: Jan. 22, 1991

[54] ELEVATOR LOAD WEIGHING

[75] Inventor: John K. Salmon, South Windsor, Conn.

[73] Assignee: Otis Elevator Company, Farmington, Conn.

[21] Appl. No.: 444,334

[22] Filed: Nov. 30, 1989

[51] Int. Cl.[5] ..... B66B 5/14

[52] U.S. Cl. ..... 187/1 R; 187/131; 73/862.54; 177/132

[58] Field of Search ..... 73/862.54, 862.56; 177/132; 187/1 R, 131, 106, 130

[56] References Cited

U.S. PATENT DOCUMENTS

| | | | |
|---|---|---|---|
| 2,411,023 | 11/1946 | Bruns | 177/132 |
| 2,761,038 | 8/1956 | Bruns et al. | 187/131 X |
| 3,164,014 | 1/1965 | Redner | 177/211 X |
| 3,323,606 | 6/1967 | Bruns et al. | 177/147 |
| 3,610,342 | 10/1971 | Stainken | 177/147 |
| 4,078,623 | 3/1978 | Ohta et al. | 177/45 |
| 4,223,752 | 9/1980 | Belcher | 177/211 |
| 4,330,836 | 5/1982 | Donofrio et al. | 187/131 X |
| 4,573,542 | 3/1986 | Schlegel et al. | 177/211 X |
| 4,899,852 | 2/1990 | Salmon et al. | 187/1 R |

FOREIGN PATENT DOCUMENTS 924276 4/1963 United Kingdom .

*Primary Examiner*—H. Grant Skaggs
*Assistant Examiner*—Dean A. Reichard
*Attorney, Agent, or Firm*—Breffni X. Baggot

[57] ABSTRACT

In an elevator system, sensors 14, 15 are placed at points of inflection 11 on suspension rods 3, 5 in an elevator pendulum car support assembly 1 for the purpose of measuring weight. Sensors placed at such points of inflection measure the tension in the rods and lead to electrical circuitry 20 to cause an output signal proportional to the load on the cab independent of bending moments exerted upon the ends of the rods.

4 Claims, 1 Drawing Sheet

ELEVATOR LOAD WEIGHING

TECHNICAL FIELD

This invention relates to the weighing of an elevator cab, in particular, with respect to a pendulum car support assembly.

BACKGROUND ART

It is important to the function of an elevator that its load be known at all times - whether to determine if the car is overloaded so that the elevator brake is not released while under that load or to determine which floors should be serviced. Several types of elevator weighing systems have been used.

Elevator load weighing systems may be divided into two groups: those that place a sensor beneath the cab platform and those that do not.

All elevator cab support means are subject to three kinds of forces: the vertical force of gravity upon the load, a bending load in the support member, and a horizontal force caused by the elevator moving forward or backward or from side to side within the hoistway. The goal of a load weighing system is to measure only one of these forces—the gravity force upon the load. A load in the center of the cab will exert a bending moment on the cab supports. A horizontal force exerted upon the cab may also cause the cab supports to momentarily bend. Attempts at measuring the cab load must account for these bending forces.

Several systems have been designed with the load-weigher beneath the car. Some measure the deformation of resilient pads beneath the car platform, U.S. Pat. No. 4,078,623, others use loadcells, U.S. Pat. No. 4,330,836, and still others, U.S. Pat. No. 4,573,542 and U.S. Pat. No. 4,223,752, use strain gauges on the cab supporting members. None of them deal with the problem of the bending moments experienced by rod supports. A disadvantage of the deformation systems is the inaccuracy introduced by hysteresis in the elastomeric material used in the pads. Although systems that use strain gauges attached to the cab supports are desirable in that the cost of strain gauges is low; such systems, nevertheless, do not account for bending moments. Systems which use loadcells are undesirable simply because of the cost of a member which must both support the load and measure it. None of the above systems give the most precise load measurements since they do not account for the bending moment in the cab supports. One solution to this problem is to modify the above load weighing systems to subtract the bending moment from the output of the measuring transducer. This, however, requires additional components and circuitry.

Attempts at weighing the load have also been made from a point other than beneath the car. One system places a sensor on the elevator rope, United Kingdom Patent No. 924,276. This system has an advantage in that it does avoid the problem with the bending moment. It does not, however, account for the fact that stretching in the rope is different at different points in the rope and at different times. A second system, U.S. Pat. No. 2,761,038, places a microswitch on the crosshead and measures a threshold amount of bending in the crosshead. This system only determines if an overload exists and does not give a continuous measure of the load. A third system, U.S. Pat. No. 2,411,023, measures the deflection of the elevator car crosshead by positioning cantilever arms on the front and back of the crosshead; a sensor on the underside of the crosshead measures the weight on the beam: here, the elevator cab, frame, compensating ropes and traveling cable. Another system, U.S. Pat. No. 3,323,606, involves a rotating bedplate having hoistway ropes connected to the car and counterweight; as the bedplate rotates it rotates with the hoistway ropes connected to the car. The displacement of the rotating bedplate measures the load on the bedplate, namely the elevator car, hoist cables, traveling cables and compensating ropes. Another load weighing system, U.S. Pat. No. 3,610,342, operates by measuring the torque delivered to a brake disk; as the brake closes upon the disk a sensor indicates the torque on the disk, and therefore the elevator cab, hoist ropes, compensating ropes and travel cable.

What all of these systems give with one hand they take away with the other. These systems which do not measure load from beneath the cab do avoid the need to compensate for a bending moment; however, they require that compensation for another factor—the weight of the compensating ropes and traveling cable. The weight of compensating ropes and traveling cable will vary from one end of the elevator shaft to the other making the load measurement dependent upon where the car is within the shaft. Weighing the elevator at the top of the shaft requires weighing the entirety of both the compensating ropes and travel cable, while weighing the elevator at the bottom of the shaft will require weighing very little of them. A second disadvantage of these systems is the relative error encountered in attempting to distinguish the cab load from a measurement that yields the weight of the cab, car frame, hoist ropes, compensating ropes, and travel cable.

While all of the above systems are to some extent successful in weighing the elevator, none of them both avoids non-axial loads and is suitable for use in a pendulum car support assembly.

DISCLOSURE OF THE INVENTION

Objects of the invention include: measuring the weight of an elevator cab directly with no need for circuitry which measures lateral forces on the car, measuring the weight of the cab with a sensor that does not also support the car, weighing the car and frame in such a manner that the compensating ropes and travel cable beneath the car, and hoist ropes above the car, need not be measured.

This invention is predicated upon two generally known scientific theories. First, that when a beam is subject to two bending moments, one at either end, causing one portion of the beam to be convex up in one direction while the other is convex down in an opposite direction, there is no bending moment at the center of the beam; that is, at the joinder of those portions. Second, the theory of least work or least action, that a system in nature will do the least work required of it; here, that when the free end of a beam fixed at one end experiences a force applied transverse to it, it will not kink, but bend in an arc.

According to the invention, in a pendulum elevator car support assembly, a load sensor is mounted at a point of inflection between the suspension rods where forces exerted on the ends of the rods, whether of the horizontal or bending moment type, cancel each other so that the load sensor will measure only the direct tension of the rod, and therefore only the weight of the cab.

The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
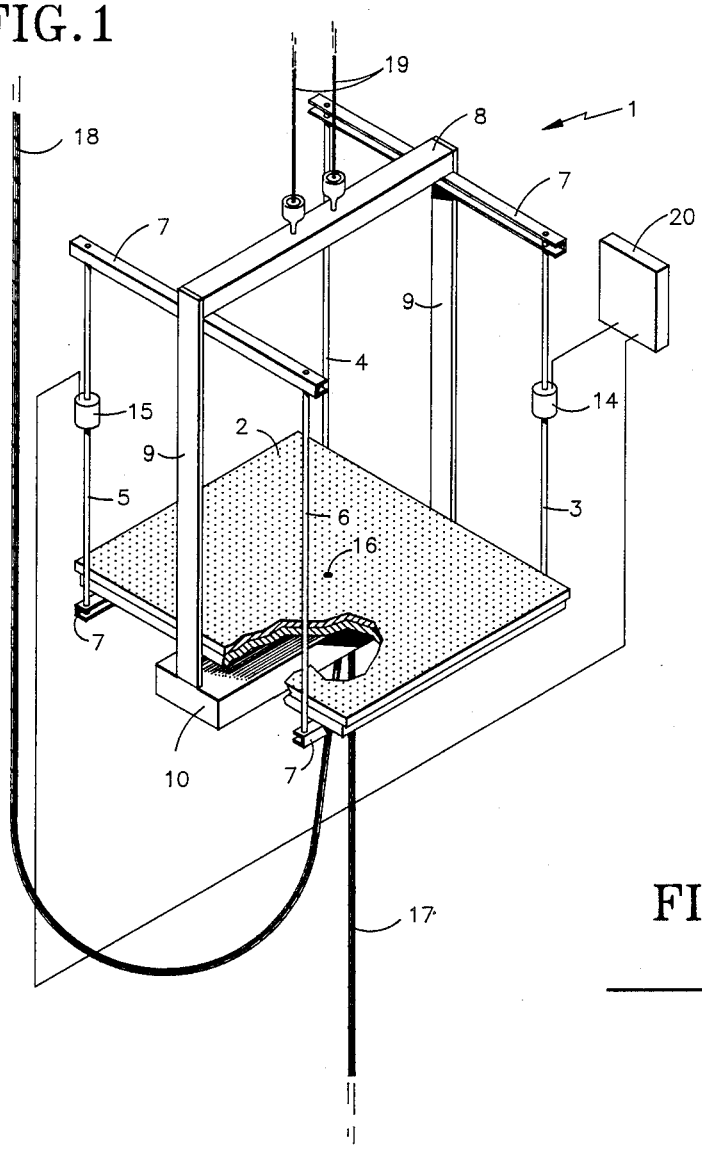
FIG. 1 is a perspective view of a pendulum car elevator support assembly incorporating the present invention.

In FIG. 1, a pendulum elevator car support assembly 1 suspends the cab platform 2 of the cab(not shown) from four steel suspension rods 3–6 which are themselves suspended by horizontal U-beams 7. The horizontal U-beams in turn are held to a top support beam 8 and vertical support beams 9 which, in turn, attach to bottom support beam 10. The suspension rods 3–6 suspend the cab platform 2. This type of elevator is disclosed by Salmon and Yoo in U.S. application, Ser. No. 07/266,540, filed on Nov. 3, 1988 now U.S. Pat. No. 4,899,852.

Figure 2:
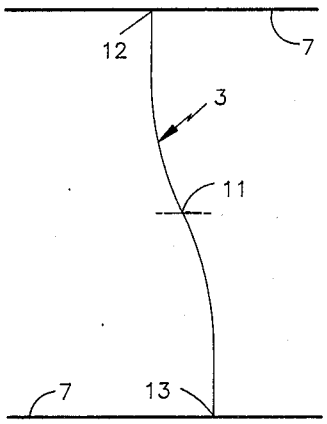
FIG. 2 is an illustrative view of the shape of a stressed elevator support rod.

In FIG. 2, stress applied to the suspension rod 3 causes the rod to assume an "s" shape(exaggerated in FIG. 2) with a point of inflection 11. At either of the ends 12, 13 of the suspension rod connected to horizontal U-beams 7 there are two forces on the rod: a bending force and a direct tension force. The bending force may be caused by a sudden horizontal force on the elevator car or because of a load on the platform. There is no bending at the point of inflection 11 because, regardless of the forces exerted on the rod, one portion of the rod is a mirror of the other; each end is effectively a cantilever with the loads on the ends acting in opposite directions. Thus, a pair of sensors 14, 15 (FIG. 1) disposed at the points of inflection of the rods measure only a direct tension force. For a uniform rod the point of inflection will be at the center of the length of the rod.

Any sensor 14, 15 will suffice, but the system only requires a strain gauge because it only measures the small amount of stretching of the suspension rods 3, 5. Each sensor may be placed on the rod so that it measures the tension in the rod and in no way supports the rod. If a strain guage is used it may be placed directly on the external portion of the rod. If desired, a loadcell may be placed within the rod such that it both weighs the load and supports it.

There must be a sensor on each of at least two rods which rods are disposed on opposite sides of the center of deflection of the cab 16 such that the shortest line connecting those rods passes through the center of deflection; because measurement of the weight on any two corners will give the weight of the car regardless of where the load is situated within the car, sensors need only be put on rods in two of the four corners. This is pointed out in U.S. Pat. No. 4,330,836 by Donofrio, et. al., issued May 18, 1982. Sensors may be placed on more than two rods, if desired.

In the pendulum car, compensating ropes 17 and travel cable 18 hang from the car frame, such as the bottom beam 10, and not the car. Thus, the weight of compensating ropes 17 and travel cable 18 beneath the platform are not measured since they bypass the elevator car; however, the invention measures the weight of compensating ropes and travel cable in elevator cars in which the travel cable and compensating ropes attach to the car platform, and in elevator cars in which the car platform connects to the bottom beam 10. Hoist ropes 19 are also not weighed since they are not directly connected to the cab(not shown). Outputs from sensors 14, 15 are output to bridge 20 or other suitable circuitry.

Although the invention has been shown and described with respect to exemplary embodiments thereof, it should be understood by those skilled in the art that various changes, omissions and additions may be made therein and thereto, without departing from the spirit and the scope of the invention.

What is claimed is:

1. An elevator system, comprising:

a cab having a cab platform, horizontal beams, and suspension rods suspending said cab platform from said horizontal beams;

at least two sensor means, each associated with a corresponding one of said rods and the point of inflection of the related one of said rods, each responsive to the tension in the corresponding one of said rods for providing a tension signal proportional to the weight suspended from said corresponding rod; and means responsive to said tension signals for providing a weight signal proportional to the weight of said cab.

2. An elevator system according to claim 1, wherein said rods are uniform, and said sensor means are disposed at the middle of the length of said rods.

3. An elevator system according to claim 1, wherein said cab has a frame supporting compensating ropes and a travel cable independently of said cab platform and said rods, whereby said sensor means are not responsive to the weight of the travel cable and compensating ropes.

4. An elevator system according to claim 1, in which said sensor means are connected to two rods disposed one opposite the other on a line passing through the center of deflection of the cab.

* * * * *